US006568771B2

(12) United States Patent
Gentili et al.

(10) Patent No.: US 6,568,771 B2
(45) Date of Patent: May 27, 2003

(54) DRAWER INTERLOCK

(75) Inventors: Stefano Gentili, Etobicoke (CA); Eugene Varaschin, Holland Landing (CA); L. Scott Deugo, Bolton (CA)

(73) Assignee: TK Canada Limited, Downsview (CA)

( * ) Notice: Subject to any disclaimer, the term of this patent is extended or adjusted under 35 U.S.C. 154(b) by 0 days.

(21) Appl. No.: 09/870,658

(22) Filed: Jun. 1, 2001

(65) Prior Publication Data

US 2002/0185943 A1 Dec. 12, 2002

(51) Int. Cl.[7] ..... E05C 7/06
(52) U.S. Cl. ..... 312/221; 312/217
(58) Field of Search ..... 312/216, 217, 312/218, 219, 221, 222, 220

(56) References Cited

U.S. PATENT DOCUMENTS

| | | | | |
|---|---|---|---|---|
| 4,298,236 A | * | 11/1981 | Laroche | 312/221 X |
| 4,480,883 A | | 11/1984 | Young | |
| 4,936,640 A | * | 6/1990 | Pratzer | 312/221 |
| 4,966,423 A | * | 10/1990 | Higuera et al. | 312/221 |
| 5,050,942 A | * | 9/1991 | Frederick et al. | 312/221 |
| 5,056,876 A | | 10/1991 | Scheerhorn | |
| 5,172,967 A | | 12/1992 | Pipe | |
| 5,184,887 A | * | 2/1993 | O'Keefe et al. | 312/221 |
| 5,333,949 A | | 8/1994 | McGregor | |
| 5,335,986 A | * | 8/1994 | Hartrum et al. | 312/217 X |
| 5,427,445 A | * | 6/1995 | Mitchell | 312/221 |
| 5,567,027 A | * | 10/1996 | McClung et al. | 312/219 |
| 5,702,167 A | * | 12/1997 | Muller | 312/221 |
| 5,931,548 A | | 8/1999 | Bischoff | |
| 5,988,778 A | | 11/1999 | Lammens | |
| 6,082,839 A | | 7/2000 | Chiku | |

FOREIGN PATENT DOCUMENTS

| | | | | |
|---|---|---|---|---|
| DE | 34 31 386 A | | 3/1986 | |
| DE | 3431386 | * | 3/1986 | 312/221 |
| GB | 2 220 026 A | | 12/1989 | |
| GB | 2 331 551 A | | 5/1999 | |

* cited by examiner

*Primary Examiner*—Lanna Mai
*Assistant Examiner*—Hanh V. Tran
(74) *Attorney, Agent, or Firm*—Bereskin & Parr

(57) ABSTRACT

A drawer interlock system for a multi-drawer filing cabinet includes respective cam units, one associated with each drawer. The cam units are aligned on a common axis and each unit includes an in-line cam assembly that includes a rotary cam and two stationary cams, one above and one below the rotary cam. When a drawer is opened, the rotary cam is turned, causing axial displacement of the stationary cams, which takes up available "play" in the system, locking the cam units of the other drawers and preventing them being opened.

12 Claims, 5 Drawing Sheets

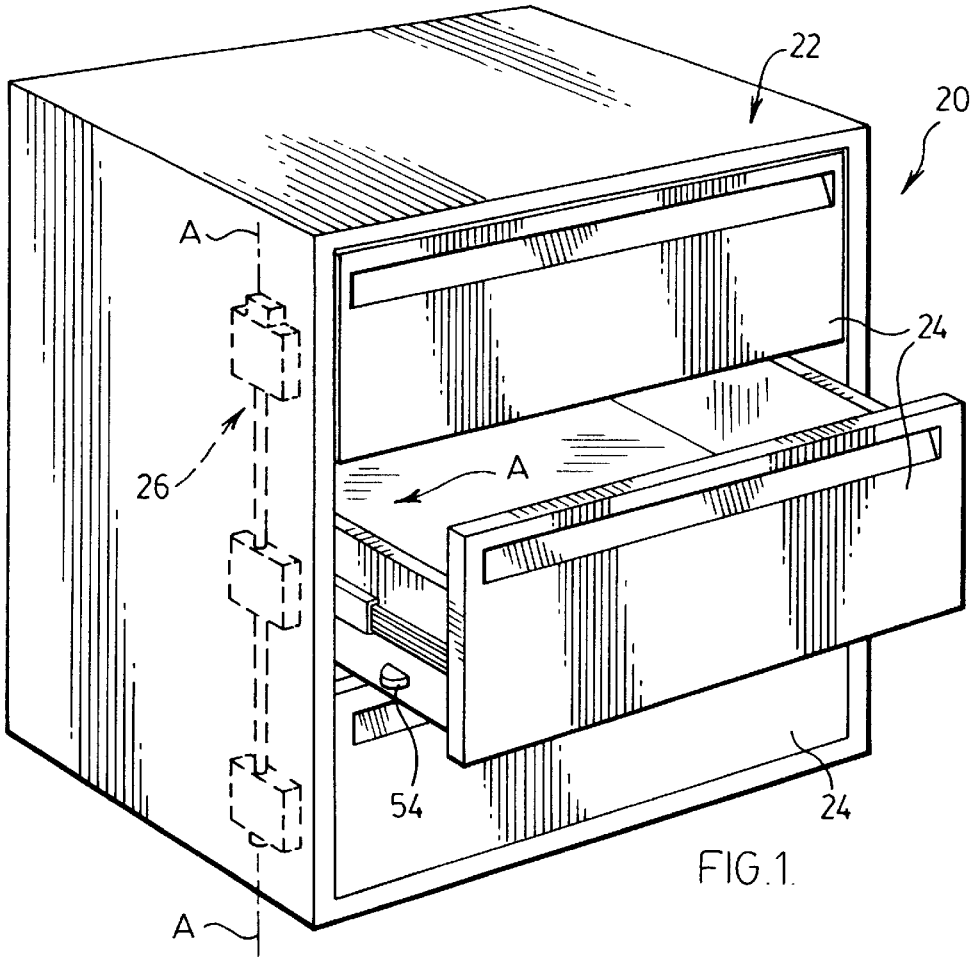
FIG. 1.
FIG. 7.
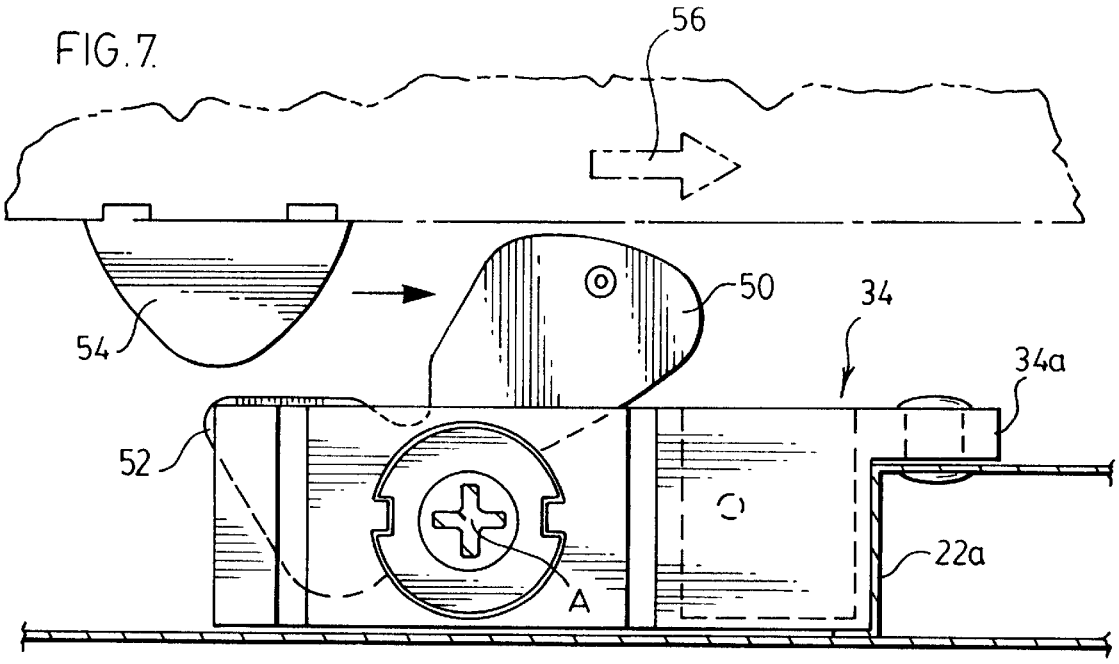

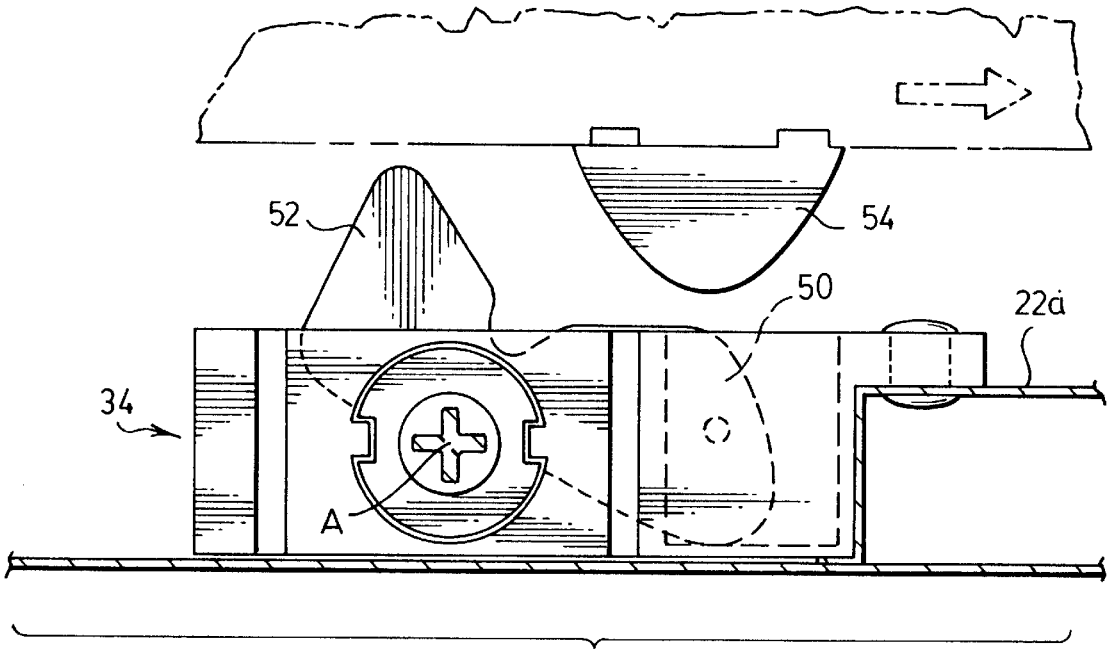
FIG. 8.
FIG. 9.
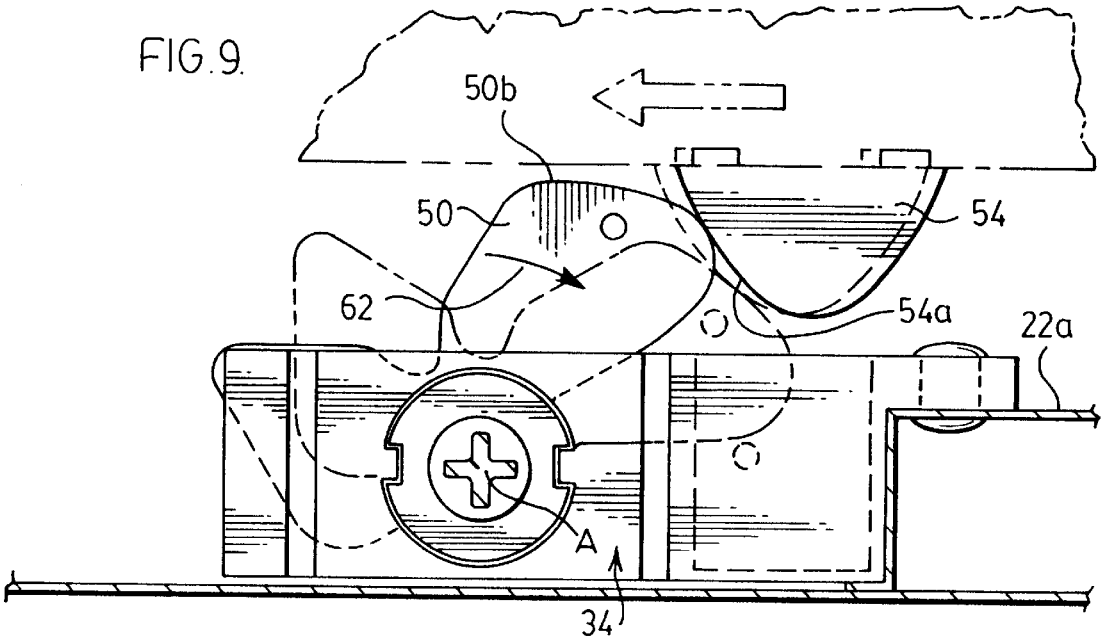

DRAWER INTERLOCK

FIELD OF THE INVENTION

This invention relates to a drawer interlock system for a multi-drawer article of furniture such as a filing cabinet.

BACKGROUND OF THE INVENTION

Drawer interlock systems are intended to prevent more than one drawer of a filing cabinet being opened at the same time, to guard against the cabinet tipping over.

U.S. Pat. No. 4,480,883 (Young) discloses an example of a prior art interlock mechanism which is designed on the principle that there is free space or "play" in the mechanism which is taken up when one drawer is opened, so that no other drawer can be opened. In the mechanism disclosed in the Young patent, a series of locking bars and intervening cam elements are stacked in a vertical channel at one side of the drawers of an upright filing cabinet. When one drawer is opened, the cam element associated with that drawer is turned, which vertically displaces the locking bars and takes up all of the available free space in the channel. The cam elements associated with the other drawers then cannot be turned and are effectively "locked out".

A difficulty with some prior art interlock systems is that they have a tendency to jam. For example, the cam element disclosed in the Young patent is rectangular in section and is disposed between adjacent locking bars for turning through 90° between a position in which the wide faces of the member are horizontal to a position in which the wide faces are vertical, spreading apart the locking bars. There is significant potential for jamming of the corners of the cam element against end faces of the respective locking bars.

A further disadvantage is that significant lateral forces are imposed on the interlock mechanism when a drawer is opened. Not only does this tend to make the mechanism noisy, but it is possible for the cam elements to over-rotate, leading to damage or jamming of the mechanism.

Examples of other prior art U.S. patents dealing with interlock systems are as follows:

| | |
|---|---|
| No. 5,056,876 (Scheerhorn) | No. 5,931,548 (Bischoff) |
| No. 5,172,967 (Pipe) | No. 5,988,778 (Lammens) |
| No. 5,333,949 (McGregor) | No. 6,082,839 (Chiku) |

SUMMARY OF THE INVENTION

An object of the present invention is to provide a drawer interlock system that addresses the disadvantages of the prior art.

The system provided by the invention is intended for use with a furniture article such as a filing cabinet, that includes a cabinet structure and at least two drawers, each of which is supported in the cabinet for movement between an open position and a closed position with respect to the cabinet. The system includes, in association with each drawer, a cam unit that is mounted on the cabinet and that includes a rotary cam assembly extending about an axis normal to the direction of movement of the associated drawer between its open and closed positions. The respective cam units are aligned on the said axis. Each cam assembly includes a rotary cam and a stationary (i.e. non-rotary) cam. The rotary cam is turnable about the said axis in response to movement in the associated drawer, between the normal position when the drawer is closed and an interlock actuating position when the drawer is open. The respective cams have co-operating cam surfaces shaped to cause (1) displacement of the stationary cam a pre-determined distance outwardly along said axis in response to turning of the rotary cam from its normal position to its interlock actuating position and (2) locking of the cams with respect to one another in the event that said displacement of the secondary cam is prevented. A locking element extends between the cam units and connects the stationary cams of the respective units. The locking element is axially displaceable in response to displacement of the stationary cam through said pre-determined distance. The system also includes means limiting axial displacement of the locking element to the pre-determined distance, so that the rotary cam of only one cam unit at a time can move to the interlock actuating position, whereupon the rotary cam of the other cam unit is locked in the normal position. The rotary cam is designed to then prevent opening of the drawer associated with that cam.

The interlock system of the invention is based generally on the same principle as prior art interlock systems discussed previously, in which there is a limited amount of free movement that is taken up when one drawer is opened, so that the system is then locked and no other drawer can be opened. However, an important distinction of the invention is that the system includes rotary cam units that incorporate in-line cams disposed on a common axis. Only minimum lateral forces are imposed on the interlock system when a particular drawer is opened and those forces are translated by the rotary cam assembly into axial forces that result in locking of the system. As such, the potential for damage to the interlock system is reduced as compared with the prior art and the system can be designed to operate much more smoothly and more quietly than prior art systems.

Preferably, the cams of the various cam units are plastic mouldings, so that there is essentially no noise when the cams operate. The cam surfaces may comprise a pair of diametrally spaced lobes and intervening recesses on one cam, and complimentary lobes and recesses on the co-operating cam. The lobes can be appropriately contoured to achieve the required cam effects, with minimum noise.

The interlock system of the invention has been designed primarily for use in association with a vertical file cabinet, in which case the interlock system extends vertically inside the cabinet adjacent one side of the drawer opening. In principle, however, the interlock system could also be used for a horizontal file cabinet by positioning the system generally horizontally, either above or below the drawer opening in the cabinet, and providing appropriate actuator elements on the drawers.

As indicated previously, the interlock system will include a cam unit for each drawer and the cam units will be interconnected by locking elements (typically rods). Accordingly, the number of rods will be one less than the number of cam units. In an example of a vertical file cabinet having three drawers, there will be one cam unit associated with each drawer and two rods, one extending up from the lower cam unit to the centre cam unit and the other extending up from that cam unit to the top cam unit. The centre cam unit will have two stationary cams, one co-operating with the lower rod and the other co-operating with the upper rod. The top cam unit may incorporate the required means for limiting axial displacement of the locking elements.

BRIEF DESCRIPTION OF DRAWINGS

In order that the invention may be more clearly understood, reference will now be made to the accompanying drawings which illustrate a particular preferred embodiment of the invention by way of example, and in which:

FIG. 1 is perspective view of a typical file cabinet fitted with an interlock system according to the invention, in which the centre drawer of the cabinet is shown in an open position;

FIGS. 7, 8 and 9 are plan views also illustrating operation of the cam unit.

DESCRIPTION OF PREFERRED EMBODIMENT

Figure 2:
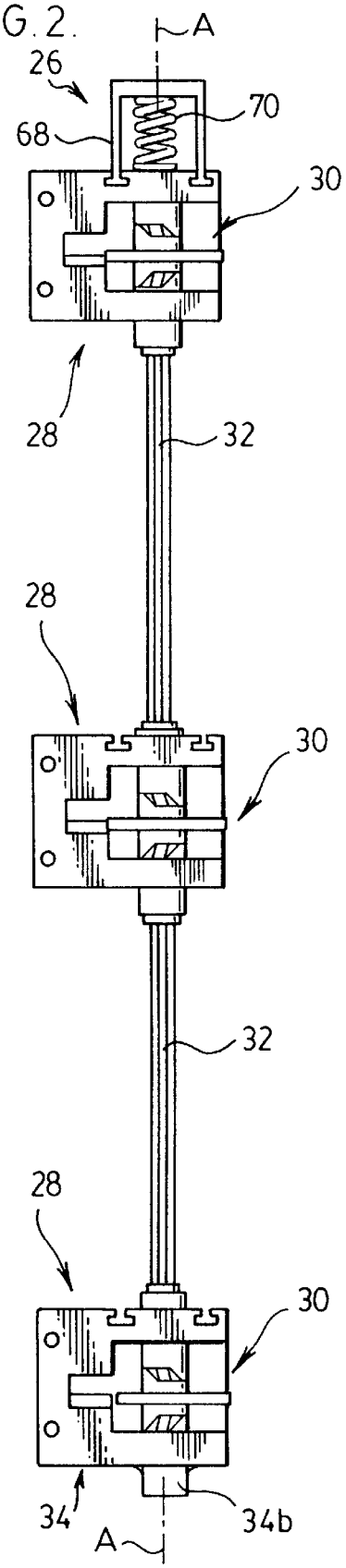
FIGS. 2 and 3 are elevational views generally in the direction of arrow A in FIG. 1, showing the interlock system respectively in a condition in which all of the drawers are closed and in which the centre drawer has been opened.

Referring first to FIG. 1, a typical vertical file cabinet is generally indicated by reference numeral 20 and includes a cabinet 22 and three drawers 24, each of which is supported in the cabinet for movement between an open position and a closed position, the centre drawer being shown partly open. The file cabinet itself is of conventional construction. A drawer interlock mechanism of the form provided by the invention is mounted on the inner surface of the left hand side panel of the cabinet as seen from the front, and is generally denoted 26. FIG. 2 shows the mechanism in a normal static position in which all three drawers 24 are closed, while FIG. 3 shows the mechanism as it would appear after the centre drawer has been opened.

Figure 3:
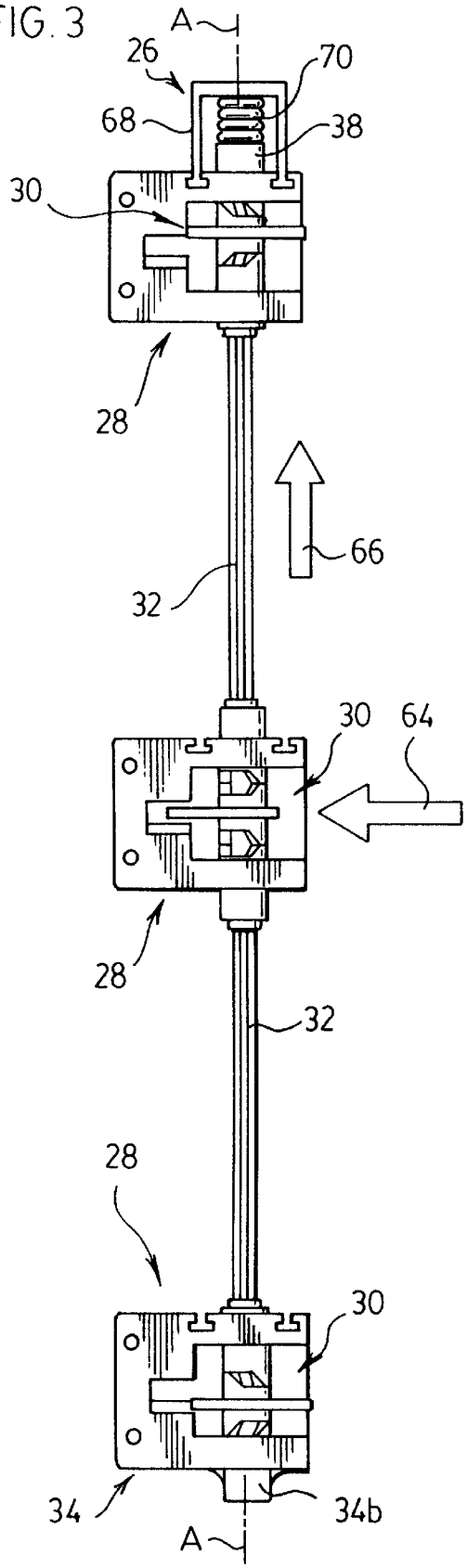

Referring now more particularly to FIGS. 2 and 3, the mechanism 26 is shown to include a cam unit 28 for each of the drawers 24. Each cam unit includes a rotary cam assembly 30 that extends about an axis normal to the direction of movement of the associated drawer between its open and closed positions. The three cam units 28 are aligned on the same axis and the axis is denoted A—A. Extending between the cam units are respective locking rods 32 which are also disposed on axis A—A.

Figure 4:
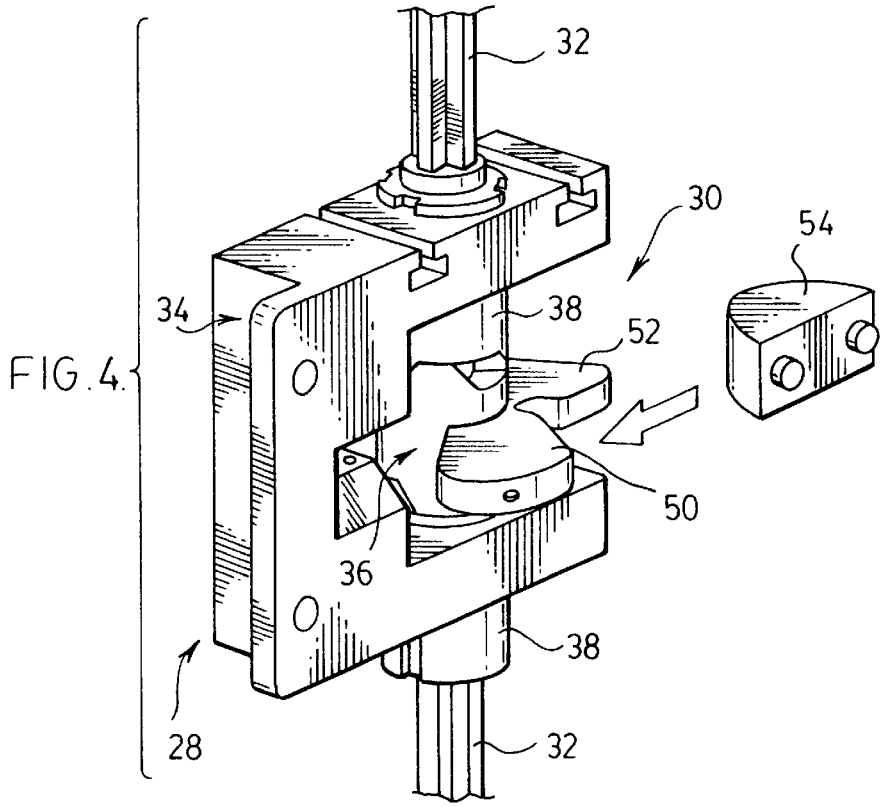
FIGS. 4 and 5 are detail perspective views illustrating operation of one of the cam units.
Figure 5:
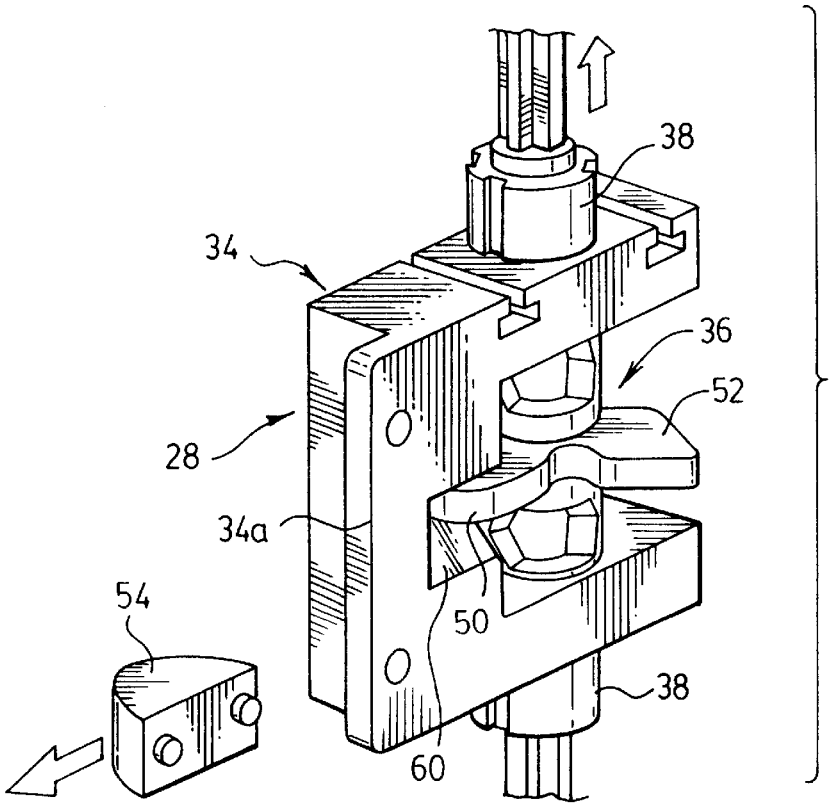
Figure 6:
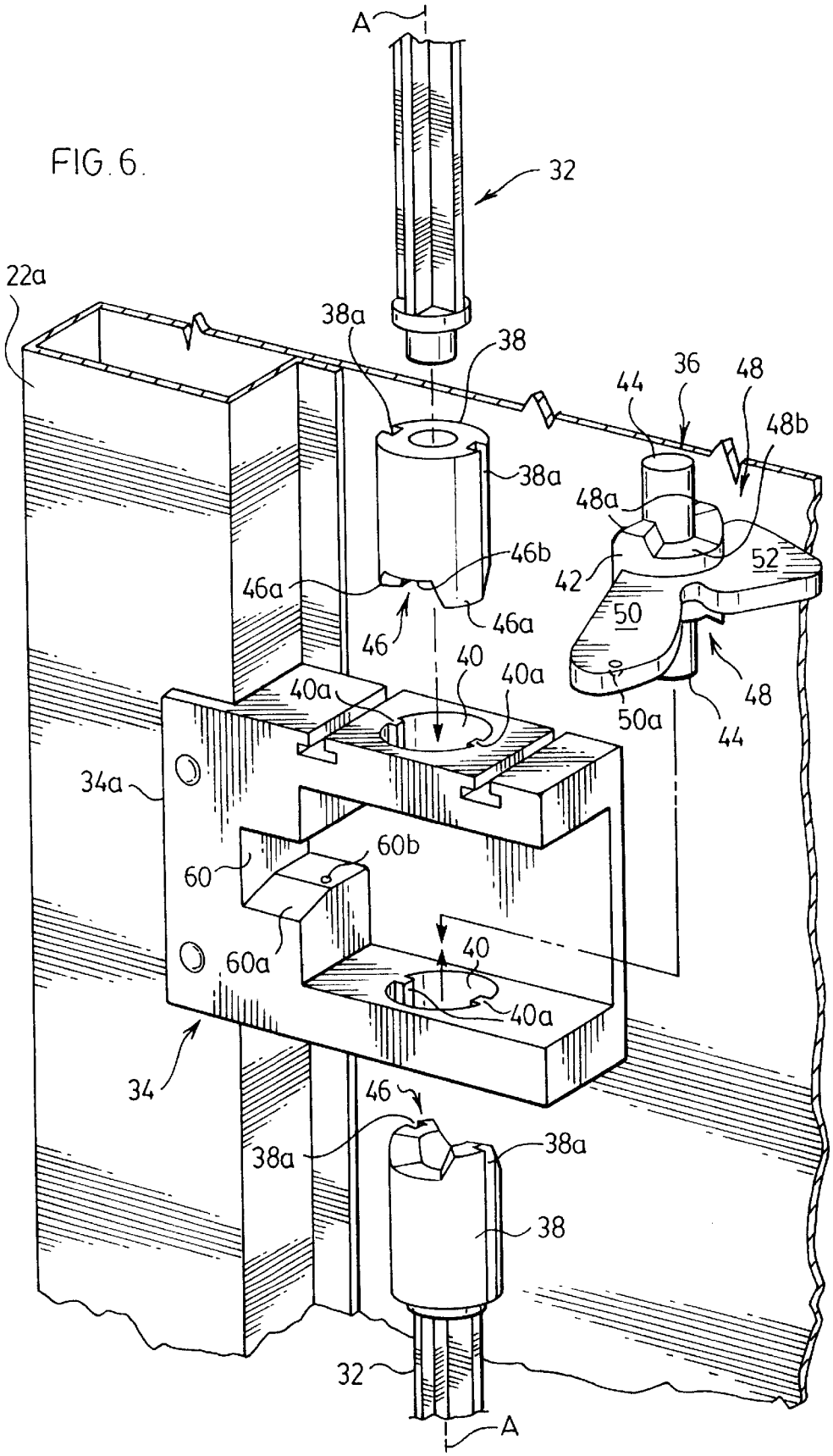
FIG. 6 is an exploded perspective view of that cam unit.

FIGS. 4, 5 and 6 show the centre one of the three cam units of FIGS. 2 and 3 and is representative of all three cam units, although there are some differences, which will be pointed out later. Referring primarily to FIG. 6, it will be seen that the cam unit includes a housing 34 having a flange 34*a* by which the housing can be secured (e.g. by screws) to a box section frame member 22*a* at the relevant side of the front opening in the file drawer cabinet 22. The cam assembly of the cam unit includes a rotary cam 36 and two stationary cams 38. In the assembled cam unit, the two stationary cams 38 are disposed respectively above and below the rotary cam 36 on axis A—A, as best seen in FIGS. 4 and 5. The rotary cam 36 is turnable about axis A—A in response to movement of the associated drawer (as will be described) between a normal position when the drawer is closed and an interlock actuating position when the drawer is open.

The respective cams have co-operating cam surfaces shaped to cause displacement of one of the two stationary cams 38 a pre-determined distance outwardly along axis A—A in response to turning of the rotary cam from its normal position to its interlock actuating position. The cam surfaces are also designed so that the cams are locked with respect to one another in the event that displacement of the secondary cam is prevented.

It can be seen from FIG. 6 that each of the stationary cams 38 is essentially a cylindrical cam element and that the two cams are received for sliding movement in the direction of axis A—A in respective openings 40 in housing 34. A pair of diametrally opposed keyways 38*a* in the external surface of each cam mate with corresponding keys 40*a* in housing 34 so that, in the assembled condition, the two cams 38 are slidable axially in the two openings 40 but are held against rotation with respect to the rotary cam 36. Cam 36 fits between the two stationary cams 38 and comprises a cylindrical central cam element 42 and respective axial projections 44 that are received in complimentary cylindrical openings in the two stationary cams 38 so that the rotary cam can turn with respect to the stationary cams. The locking rods 32 have cylindrical end portions 32*a* (FIG. 6) that fit into these openings at outer distal ends of the respective cams 38.

Inner ends of the stationary cams 38 are shaped to define respective cam surfaces 46 that match corresponding, opposed cam surfaces 48 on the rotary cam 36. The upper one of those two surfaces 48 is best seen in FIG. 6 and it will be seen that the surface defines a pair of diametrally opposed raised lobes 48*a* and intervening recesses 48*b*. Complimentary lobes and recesses 46*a* and 46*b* respectively are provided on the inner ends of the two stationary cams 38. The respective cam surfaces are smoothly contoured so that they ride easily on one another and with minimum noise.

In the normal rest condition of the cam unit with the associated drawer closed, the projecting cam lobes 46*a* of the rotary cam are received in the complimentary recesses 46*b* of each of the two stationary cams 38. Starting from that condition, if the lower cam 38, for example, is prevented from axial displacement and cam 36 is turned an appropriate angular amount, the two lobes 48*a* of the lower cam surface 48 of cam 36 will ride up onto the two lobes 46*a* of the cam surface 46 at the top of the lower cam 38. Similarly, the upper cam surfaces 48 on cam 36 will ride up onto the lobes 46*a* of the upper cam 38 and that cam will be displaced axially upwardly through a pre-determined angular amount corresponding to twice the height of the respective cam lobes. On the other hand, if the upper cam 38 is also restrained from axial movement, the cam assembly will effectively be locked and rotary cam 36 will be held against rotation.

Rotary cam 36 has two projecting tabs 50 and 52 that are specially shaped and appropriately contoured to co-operate with an actuator element 54 that projects laterally from a side of the drawer 24 associated with the particular unit. FIG. 7 shows the rotary cam unit 36 in its normal position when the associated drawer 24 is closed. When the drawer 24 is opened as indicated by arrow 56 in FIG. 7, actuator element 54 will contact tab 50 and rotate cam 36, pressing tab 50 into cam unit housing 34. This motion causes tab 52 to be extended from the housing into the return path of actuator element 54 so that the cam will be rotated in the opposite direction when the drawer is returned.

FIG. 6 shows that housing 34 includes a recess 60 that accommodates tab 50. The recess has an entry ramp 60*a* and includes a detent 60*b* that co-operates with a corresponding recess 50*a* in tab 50 to positively locate and retain the tab within recess 60. This will tend to hold the rotary cam in its interlock actuating position so that all of the other drawers will be locked out and prevented from opening. Nevertheless, it is possible that cam 36 may inadvertently be counter-rotated so that the tab 50 will be in the path of the actuator element 54 when the drawer is returned. Tab 50 and actuator element 54 are profiled so that the edge surface 54*a* of actuator element 54 will co-act with edge surface 50*b* of tab 50 and press the tab back into cam unit housing 34 as indicated by arrow 62 in FIG. 9. In other words, return movement of the drawer will not be blocked by rotary cam 36. This feature can also be useful during initial assembly of the filing cabinet in that it will not be necessary to manually set the rotary cams 36 of all of the cam units so that the corresponding drawers can be inserted into the cabinet.

To summarize, starting from a condition in which all of the drawers of the filing cabinet are closed, the act of opening one drawer will cause the actuator element 54 of that drawer to move towards the tab 50 of rotary cam 36 of the cam unit associated with that drawer as indicated in FIG. 7. As the actuator element 54 contacts and moves past the cam 36, the cam will be rotated in the clockwise direction as seen in FIG. 7, to the position shown in FIG. 8, in which the tab 52 of the cam projects from cam unit housing 34. Turning of the rotary cam 36 in this direction will cause corresponding axial movement of one of the locking rods 32 associated with that cam unit.

For example, if the centre drawer is being opened, the rotary cam 36 of the centre cam unit 28 will be rotated and will move up from the position shown in FIG. 2 to the position shown in FIG. 3. Arrow 64 in that view indicates opening of the drawer, while arrow 66 indicates upward axial movement of the rod 32 that is above the centre cam unit. It will be remembered that the lower cam unit has not been affected at this time so that its cams are effectively locked and the lower rod 32 is prevented from moving down. Movement of the upper rod as indicated by arrow 66 causes corresponding upward displacement of the cams of the upper cam unit. However, those cams remain locked and no rotation takes place. Accordingly, the rotary cams of the upper and lower cam units 28 remain in the position shown in FIG. 7 in which their tabs 50 project into the path of the actuator elements 54 of the associated drawers. However, since the cams are locked, the actuator elements 54 cannot rotate the cams and the associated drawers cannot be opened.

The mechanism is designed to provide a limited amount of free space or "play" corresponding to the amount by which one of the locking rods 32 is axially displaced when the rotary cam 36 of one of the cam units is moved to its interlock actuating position (the position shown in FIG. 8). As seen in FIG. 3, the extent of this free space or "play" is defined by a housing element 68 that is fitted to the cam housing 34 of the upper cam unit 28 and into which the upper stationary cam 38 of that unit projects when the interlock mechanism is actuated. A compression spring 70 is provided between and inner end wall of housing 68 and the cam 38 and is fully compressed when full axial movement of one of the locking rods 32 has occurred, as shown in FIG. 3. FIG. 2 shows the interlock mechanism in its normal rest position with spring 70 extended. In that condition, the spring simply maintains contact between the co-operating cam surfaces of the respective cams and the cam units 28.

The corresponding lower stationary cam 38 of the bottom cam unit is accommodated in a part 34*b* of cam unit housing 34 and does not move axially.

When a drawer is closed, the actuator element 54 of that drawer will contact the other tab 52 of the rotary cam of the associated cam unit, and rotate the cam back to its normal (non-actuating) position so that the spring 70 will return the upper rod 32 downwardly and the mechanism will revert to its normal "drawer closed" position.

In this particular embodiment, the interlock mechanism is assembled from plastic moulded components; accordingly, the mechanism is quiet in operation. The various cam surfaces in particular are smoothly profiled to ensure smooth, quiet operation. Other materials may of course be used. The fact that the mechanism incorporates what might be termed "in line" rotary cams which are subjected only to minimal lateral forces when a drawer is opened are major factors in quiet and smooth operation of the mechanism as a whole.

Locking rods 32 may be made available in a range of lengths to suit different drawer sizes. The stationary cam 38 could be moulded integrally with the locking rods 32.

It is of course to be understood in general that the preceding description relates to a particular preferred embodiment of the invention and that many modifications are possible within its broad scope. Some of those modifications have been indicated previously and others will be apparent to a person skilled in the art. In the "minimum" case of a two-drawer file cabinet, there will of course be only two cam units; each unit may have only one stationary cam 38.

We claim:

1. An interlock system for a furniture article comprising a cabinet and at least two drawers, each of which is supported in the cabinet for movement between an open position and a closed position with respect to the cabinet;

the system comprising:

in association with each drawer, a cam unit that is mounted on the cabinet and includes a rotary cam assembly extending about an axis normal to the direction of movement of the associated drawer between its open and closed positions, the respective cam units being aligned on said axis; and an actuator element carried by the drawer;

each cam assembly including a rotary cam and a stationary cam, the rotary cam being turnable about said axis by said actuator element in response to movement of the associated drawer between a normal position when the drawer is closed and an interlock actuating position when the drawer in open, the respective cams having co-operating cam surfaces shaped to cause (1) displacement of the stationary cam a pre-determined distance outwardly along said axis in response to turning of the rotary cam from said normal position to said interlock actuating position, and (2) locking of the cams with respect to one another in the event that said displacement of the stationary cam is prevented; said rotary cam including first and second tabs that project outwardly from said axis and are angularly spaced from one another, said first tab projecting into the path of said actuator element when the cam is in its said normal position, whereby the actuator element displaces the first tab and causes rotation of the cam to move the cam to its interlock actuating position and bring the second tab into position for contact by the actuator element when the drawer is returned to its closed position; said cam unit including a housing having a recess into which said first tab is displaced by the actuator element when the associated drawer is moved from its closed position to its open position, and in which the first tab is retained until the second tab is contacted by the actuator element as the drawer is returned to its closed position and the rotary cam begins to return to its said normal position;

a locking element that extends between said cam units and connects the stationary cams of the respective units, the locking element being axially displaceable in response to said displacement of the stationary cam through said pre-determined distance; and, means limiting axial displacement of said locking element to said pre-determined distance so that the rotary cam of only one cam unit at a time can move to said interlock actuating position, whereupon the rotary cam of the other cam unit is locked in said normal position, each said rotary cam preventing opening of the associated drawer when the rotary cam is locked in said normal position.

2. An interlock system as claimed in claim 1, wherein said first tab and said actuator element are profiled so that the actuator element can displace the first tab during return movement from said open position to said closed position of the drawer, in the event that the rotary cam is in said normal position during return movement of the drawer.

3. An interlock system as claimed in claim 1, wherein the system further comprises co operating key and keyway means coupling each said stationary cam with said cam unit housing so that each stationary cam is capable of sliding movement along said axis but is retained against rotation with respect to said housing.

4. An interlock system as claimed in claim 3, for use with a said furniture article having at least three drawers comprising respective end drawers and at least one intermediate drawer, wherein each said cam unit includes a single said rotary cam, and two stationary cams on respectively opposite sides of said rotary cam, said co-operating cam surfaces being provided between each of said stationary cams and the rotary cam, whereby both rotary cams are displaced axially outwardly in response to movement of the rotary cam from its normal position to its interlock actuating position, each of said stationary cams associated with a said intermediate drawer co-operating with respective locking elements that extend outwardly from that cam unit, the outermost stationary cams of the cam units associated with the end drawers serving solely as reactive cams for said rotary cam.

5. An interlock system as claimed in claim 4, wherein the respective cams comprise cylindrical cam elements with said co-operating cam surfaces on end faces of the elements.

6. An interlock system as claimed in claim 5, wherein said locking elements comprise rods that extend between and connect the stationary cams of adjacent cam units.

7. An interlock system as claimed in claim 6, wherein said locking rods are separate elements that are made available in different lengths to suit cabinets that accommodate different drawer sizes.

8. An interlock system as claimed in claim 1, wherein said cam units and locking elements comprise moulded plastic components.

9. An interlock system as claimed in claim 1, wherein said co-operating cam surfaces comprise a pair of diametrally spaced lobes and intervening recesses on one cam, and complimentary lobes and recesses on the co-operating cam.

10. An interlock system as claimed in claim 1, wherein each said cam unit includes a single rotary cam and two stationary cams on respectively opposite sides of the rotary cam, said co-operating cam surfaces being provided between each of said stationary cams and the rotary cam, whereby both stationary cams are displaced axially outwardly in response to movement of the rotary cam from its normal position to its interlock actuating position, and wherein said housing of the cam unit is adapted to be mounted on a side wall of said cabinet, the housing of a cam unit that is to be associated with an endmost one of said drawers including a compression spring which co-operates with the outermost stationary cam of said cam unit, and a housing element coupled to said cam unit housing and receiving said compression spring, the compression spring acting between an inner end wall of the housing element and said stationary cam for maintaining contact between the co-operating cam surfaces of the respective cams in the respective cam units when the interlock system is installed in said cabinet.

11. A furniture article comprising a cabinet and at least two drawers each of which is supported in the cabinet for movement between an open position and a closed position with respect to the cabinet, and a drawer interlock system coupled to said cabinet at an inner side thereof so as to extend about an axis normal to the direction of movement of the drawers between their open and closed positions;

the system comprising:

in association with each drawer, a cam unit that includes a rotary cam assembly extending about said axis; and an actuator element carried by the drawer;

each cam assembly including a rotary cam and a stationary cam, the rotary cam being turnable about said axis by said actuator element in response to movement of the associated drawer between a normal position when the drawer is closed and an interlock actuating position when the drawer in open, the respective cams having co-operating cam surfaces shaped to cause (1) displacement of the stationary cam a pre-determined distance outwardly along said axis in response to turning of the rotary cam from said normal position to said interlock actuating position, and (2) locking of the cams with respect to one another in the event that said displacement of the stationary cam is prevented; said rotary cam including first and second tabs that project outwardly from said axis and are angularly spaced from one another, said first tab projecting into the path of said actuator element when the cam is in its said normal position, whereby the actuator element displaces the first tab and causes rotation of the cam to move the cam to its interlock actuating position and bring the second tab into position for contact by the actuator element when the drawer is returned to its closed position; said cam unit including a housing having a recess into which said first tab is displaced by the actuator element when the associated drawer is moved from its closed position to its open position, and in which the first tab is retained until the second tab is contacted by the actuator element when the drawer is returned to its closed position and the rotary cam begins to return to its said normal position;

a locking element that extends between said cam units and connects the stationary cams of the respective units, the locking element being axially displaceable in response to said displacement of the stationary cam through said pre-determined distance; and, means limiting axial displacement of said locking element to said pre-determined distance so that the rotary cam of only one cam unit at a time can move to said interlock actuating position, whereupon the rotary cam of the other cam unit is locked in said normal position, each said rotary cam preventing opening of the associated drawer when the rotary cam is locked in said normal position.

12. A furniture article as claimed in claim 11, which comprises a vertical file drawer, in which the drawers are stacked vertically, and the drawer interlock system extends about a said axis which is vertical, the interlock system being mounted on an inner wall of the cabinet adjacent the drawers.

* * * * *